United States Patent [19]

Toyoda et al.

[11] 4,183,831

[45] Jan. 15, 1980

[54] 5-ETHYL-4-METHYL-METHYLNICOTINATE PERFUME COMPOSITIONS

[75] Inventors: Takaaki Toyoda, Ageo; Shigeru Muraki, Ryugasaki, both of Japan

[73] Assignee: Takasago Perfumery Co., Ltd., Tokyo, Japan

[21] Appl. No.: 913,927

[22] Filed: Jun. 8, 1978

[30] Foreign Application Priority Data

Jun. 10, 1977 [JP] Japan ..... 52-67970

[51] Int. Cl.[2] ..... C11B 9/00

[52] U.S. Cl. ..... 252/522 R

[58] Field of Search ..... 252/522

[56] References Cited

PUBLICATIONS

E. Wenkert et al., J. Amer. Chem. Soc., 87, pp. 5461–5467, 1965.

Steffen Arctander, Perfume and Flavor Chemicals, published by author, Montclair, N.J., 1969, Monograph 2126.

*Primary Examiner*—Veronica O'Keefe

*Attorney, Agent, or Firm*—Sughrue, Rothwell, Mion, Zinn and Macpeak

[57] ABSTRACT

A perfume composition containing 5-ethyl-4-methyl-methylnicotinate and a method of improving the naturalness of the fragrance of a perfume composition.

1 Claim, No Drawings

5-ETHYL-4-METHYL-METHYLNICOTINATE PERFUME COMPOSITIONS

BACKGROUND OF THE INVENTION

1. Field of the Invention

This invention relates to perfume compositions, and more particularly to perfume compositions containing 5-ethyl-4-methyl-methylnicotinate. This invention also relates to a method of improving the naturalness of the fragrance of perfume compositions.

2. Description of the Prior Art

Few examples are known in the prior art in which a nitrogen-containing compound is used in a floral preparation perfume. Only indole, an ester of anthranilic acid, certain nitrile compounds and the like are known as nitrogen-containing compounds useful in perfume compositions.

5-Ethyl-4-methyl-methylnicotinate is a known compound and is described in, for example, E. Wenkert et al, *J. Amer. Chem. Soc.*, vol. 87, pp 5461 (1965). However, no description appears in the prior art as to the use of 5-ethyl-4-methyl-methylnicotinate in perfume compositions, nor as to the improvement (or increase) in the naturalness of the fragrance of perfume compositions containing 5-ethyl-4-methyl-methylnicotinate.

SUMMARY OF THE INVENTION

An object of this invention is to provide a perfume composition which has a high fragrance character and in which the harmonious character of the perfume composition is markedly increased (or improved).

Accordingly, this invention in one embodiment provides a perfume composition which contains 5-ethyl-4-methyl-methyl-nicotinate.

In another embodiment, this invention provides a method of improving or increasing the naturalness of the fragrance of a perfume composition comprising adding an organoleptically effective amount of 5-ethyl-4-methyl-methylnicotinate to the perfume composition.

DETAILED DESCRIPTION OF THE INVENTION

The usefulness of 5-ethyl-4-methyl-methylnicotinate as a perfume or a perfume component in perfume compositions has only now been found in this invention. 5-Ethyl-4-methyl-methylnicotinate can be mixed with other fragrance-imparting components to prepare perfume compositions having various floral fragrances. Unexpectedly, the naturalness of the fragrance of the thus-obtained perfume compositions is extremely high, such as that of, for example, natural jasmine, natural nerol, natural gardenia, natural ylangylang or natural tuberose.

A suitable amount of 5-ethyl-4-methyl-methylnicotinate which can be used to achieve the fragrance character described above will vary depending upon the purpose of use, etc., but is generally about 0.1 to about 0.5% by weight based on the total weight of the perfume composition. Within this range, the desirable effects achieved in perfume compositions can sufficiently be obtained.

5-Ethyl-4-methyl-methylnicotinate can be prepared, e.g., as described in E. Wenkert et al, supra, according to the following schematic:

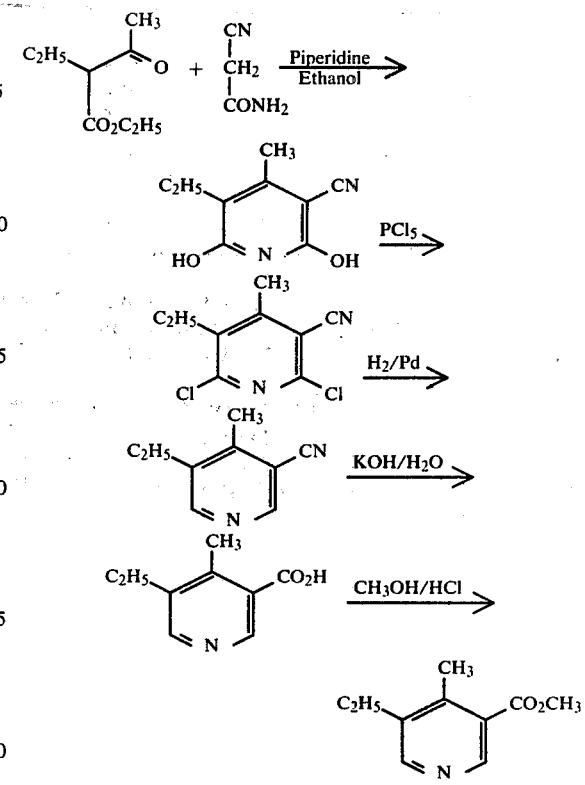

The present invention will be explained in more detail by reference to the following Examples, however, the present invention is to be not construed to be limited thereto.

EXAMPLE 1

Natural Jasmine-like Perfume Composition

The perfume components set forth below were mixed in the amounts indicated to obtain a perfume composition.

| | |
|---|---|
| Benzyl Acetate | 250 g |
| Linalyl Acetate | 150 g |
| Indole | 3 g |
| cis-Jasmone | 5 g |
| Phenylacetaldehyde Dimethylacetal | 30 g |
| Eugenol | 8 g |
| p-Cresyl Phenylacetate | 5 g |
| Hydroxycitronellal | 10 g |
| Benzyl Alcohol | 366 g |
| Mimosa Absolute | 33 g |
| Ylang-ylang Oil | 10 g |
| 5-Ethyl-4-methyl-methylnicotinate (10% soln.) | 10 g |

EXAMPLE 2

Natural Nerol-like Perfume Composition

The perfume components set forth below were mixed in the amounts indicated to obtain a perfume composition.

| | |
|---|---|
| Linalool | 250 g |
| Linalyl Acetate | 30 g |
| β-Phenylethyl Alcohol | 150 g |
| Nerol | 50 g |
| Phenylacetaldehyde Dimethylacetal | 40 g |

-continued

| | |
|---|---|
| Hydroxycitronellal | 50 g |
| Methyl Anthranilate | 60 g |
| Geranyl Formate | 40 g |
| Indole (10% soln.) | 20 g |
| α-Aminocinnamic Aldehyde | 10 g |
| n-Decanal | 10 g |
| Methyl Naphthyl Ketone | 30 g |
| Petigrain Oil | 100 g |
| Ylang-ylang Oil | 10 g |
| 5-Ethyl-4-methyl-methylnicotinate (10% soln.) | 10 g |

The perfume composition prepared in Example 1 had a natural jasmine-like fragrance, and the perfume composition prepared in Example 2 had a natural nerol-like fragrance.

The perfume compositions prepared in Examples 1 and 2 above were compared organoleptically with comparative perfume compositions prepared in the same manner and having the same composition as described in Examples 1 and 2 above except that the 5-ethyl-4-methyl-methylnicotinate was not used. The perfume compositions of this invention of Examples 1 and 2 were found to have a fragrance with a high naturalness in comparison with the comparative perfume compositions.

While the present invention has been described in detail and with reference to the specific embodiments thereof, it will be apparent to one skilled in the art that various changes and modifications can be made therein without departing from the spirit and scope thereof.

What is claimed is:

1. A method of improving the naturalness of the fragrance of a perfume composition comprising adding of 5-ethyl-4-methyl-methylnicotinate to the perfume composition in an amount of about 0.1 to about 0.5% by weight based on the total weight of the perfume composition.

* * * * *